US006240791B1

(12) United States Patent
Kenney

(10) Patent No.: US 6,240,791 B1
(45) Date of Patent: Jun. 5, 2001

(54) USER-REPLACEABLE PIPETTE GUN GRIP

(76) Inventor: James W. Kenney, 2822 N. Kent Rd., Broomall, PA (US) 19008

( * ) Notice: Subject to any disclaimer, the term of this patent is extended or adjusted under 35 U.S.C. 154(b) by 0 days.

(21) Appl. No.: 09/131,104

(22) Filed: Aug. 7, 1998

(51) Int. Cl.[7] ..... B01L 3/02
(52) U.S. Cl. ..... 73/864.14
(58) Field of Search ..... 73/864.14

(56) References Cited

U.S. PATENT DOCUMENTS 5,563,356 * 10/1996 Mussi et al. ..... 73/864.14
5,616,871 * 4/1997 Kenney ..... 73/864.14

* cited by examiner

*Primary Examiner*—Thomas P. Noland

(57) ABSTRACT

A user-replaceable grip for use on the handle of a pipette gun. The grip has a length, width, thickness, attachment surface, and a gripping surface. The grip is releasably fastened to the handle of the pipette gun by fasteners without interfering with the trigger. A plurality of grips having different identifying indicia on the gripping surface are provided so that the pipette gun can be identified to ownership, function, status, or the like. Alternatively, a plurality of grips are provided having the same length and width but having a different thickness so that the shape and size of the pipette gun handle can be customized to the hand size of different technicians using the pipette gun. Since the grips are removably fastened to the pipette gun handle, the grips can be easily interchanged when the identity of the pipette gun changes or a different technician uses the pipette gun.

10 Claims, 3 Drawing Sheets

USER-REPLACEABLE PIPETTE GUN GRIP

FIELD OF THE INVENTION

The invention relates to a user-replaceable grip for a pipette gun. More particularly, the invention relates to replaceable grips having identifying indicia on the outer gripping surface for identifying the pipette gun according to ownership, function, status, or the like. The invention also relates to replaceable grips having different sizes and contours for customizing the pipette gun handle to the hand size of a particular user.

BACKGROUND OF THE INVENTION

Pipette guns, such as those disclosed in U.S. Pat. Nos. 5,090,255, 4,624,147, 3,963,061, 3,834,240, each of which is incorporated herein by reference, are well known in the prior art. Prior art pipette guns comprise an elongate handle having a generally-rectangular cross section and a pair of pipetting triggers on one surface. A technician supports the pipette gun by grasping the handle proximate the pipetting triggers.

The dimensions of the handle of prior art pipette guns are selected based on the average hand size of a technician using the pipette gun. The handle size of prior art pipette guns is often designed based on the observation that a majority of technicians are women having small hands. As a result, repetitive use of the pipette gun by a technician with large hands can cause discomfort. Conversely, if the pipette gun handle is made larger, repetitive use by a technician with small hands can cause discomfort. Since a single pipette gun is used by many technicians, any fixed handle size is likely to cause discomfort to some group of technicians. Therefore, it would be desirable to provide a pipette gun having means for adjusting the handle size to maximize comfort for any technician using the pipette gun.

A single pipette gun may be used to handle a wide variety of fluids including radioactive fluids, infectious fluids, and pure fluids. Therefore, it is important to clearly designate the pipette gun according to its current use so that contamination does not occur. In the prior art, technicians sometimes write on the pipette gun handle or apply an adhesive label to the pipette gun handle to designate its ownership, function, status, or the like. This method of identifying the pipette gun is inefficient and sloppy. Therefore, it would be desirable to provide a method of identifying a pipette gun according to ownership, function, status, or the like using a neat and replaceable indicator.

SUMMARY OF THE INVENTION

The present invention provides a user-replaceable grip for use on the handle of a pipette gun. The user-replaceable grip is easily and quickly applied to the pipette gun handle to selectively enlarge the outer gripping surface of the pipette gun handle so that a technician having a larger than average hand size can comfortably grasp the pipette gun for a long period of time. The grip is provided in various sizes so that the size of the handle may be enlarged to a size which comfortably fits any technician. If the technician using the pipette gun changes, the grip can be easily replaced with a substitute grip having a size which comfortably fits the new technician.

The replaceable grip is provided with identifying indicia on the outer surface so that the pipette gun can be identified according to ownership, function, status, or the like. If the identity, status, ownership, etc., of the grip changes, the grip can easily be replaced with a substitute grip which indicates the new identity of the pipette gun.

The user-replaceable grip comprises a thin, pliable handle wrap. The wrap is preferably a thin sheet of flexible material having a length, width, thickness, attachment surface, and gripping surface. The attachment surface of the wrap is planar so that it lies flatly in a recessed seat in the outer surface of the handle. The gripping surface of the wrap is preferably contoured for added user comfort.

The wrap has releasable fasteners fixed to and extending from its attachment surface for releasably fastening the wrap to the handle of the pipette gun without interfering with the pipette triggers. In a preferred embodiment, the releasable fasteners comprise a plurality of pliable buttons constructed and arranged to be inserted into a series of apertures in the handle of the pipette gun. The releasable fasteners are designed for releasably attaching the wrap to each outer surface of the handle except the trigger surface.

The wrap has means for folding the wrap around the intersections of adjacent outer surfaces of the handle, i.e., the corners of the handle. In a preferred embodiment, the folding means comprises lengthwise-extending, reduced-thickness portions of the wrap.

The wrap has identifying indicia on its outer gripping surface. The identifying indicia may comprise numbers, letters, specialized characters, or color. A technician is provided with a plurality of replaceable grips having a wide variety of identifying indicia contained thereon. Preferably, the identifying indicia are uniformly understood throughout the laboratory.

The present invention also provides a method of customizing the shape and size of a pipette gun handle to the hand size of different technicians. In the method in accordance with this embodiment of the invention, the technician selects one of the above-described grips which most closely corresponds to the hand size of the technician. The technician then releasably fastens the grip to the handle of the pipette gun. Each different technician thereafter may remove the grip and substitute a new grip which comfortably fits the new technician.

The present invention also provides a method of identifying a pipette gun according to ownership, function, status, or the like. In the method according to this embodiment of the invention, a technician initially identifies the pipette gun according to ownership, function, status, or the like. The technician then selects one of the above-described grips with an identifying indicia which corresponds to the identity of the pipette gun. The technician then fastens the selected grip to the pipette gun. The grip is changed each time the identity of the pipette gun changes. Preferably, the identifying indicia are established on a reference key and conform to generally accepted scientific symbols.

DETAILED DESCRIPTION OF PREFERRED EMBODIMENTS

Figure 1:
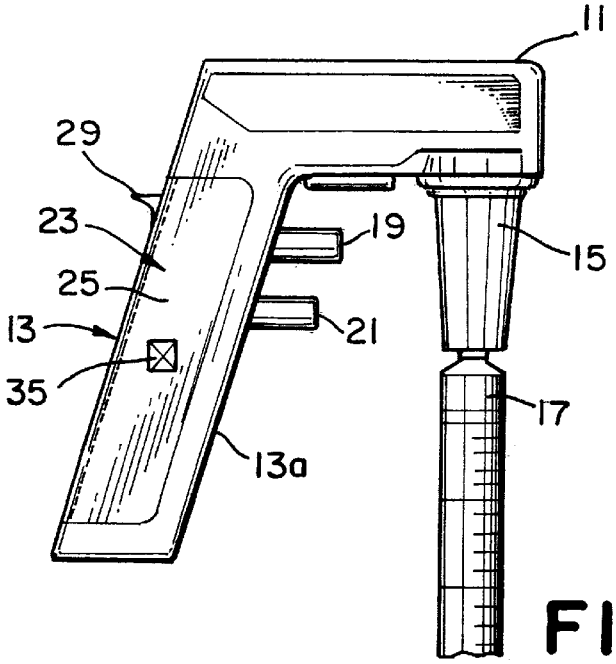
FIG. 1 is a side elevation of a pipette gun including a user-replaceable grip in accordance with an embodiment of the invention.

The invention is described below with reference to FIGS. 1–5 wherein the like reference numerals are used throughout to designate like elements.

The user replaceable grip of the present invention may be used on a variety of hand-held apparatus but has particular use on, and is descried with reference to, a pipette gun having a barrel 11, handle 13, pipette tube connector 15, suction trigger 19, and expulsion trigger 21. The handle 13 of the pipette gun typically has a generally-rectangular cross section as seen, for example, in FIG. 3. The user-replaceable grip 23 of the present invention is attached over or wrapped around the handle 13 as seen in FIGS. 1 and 3.

Figure 3:
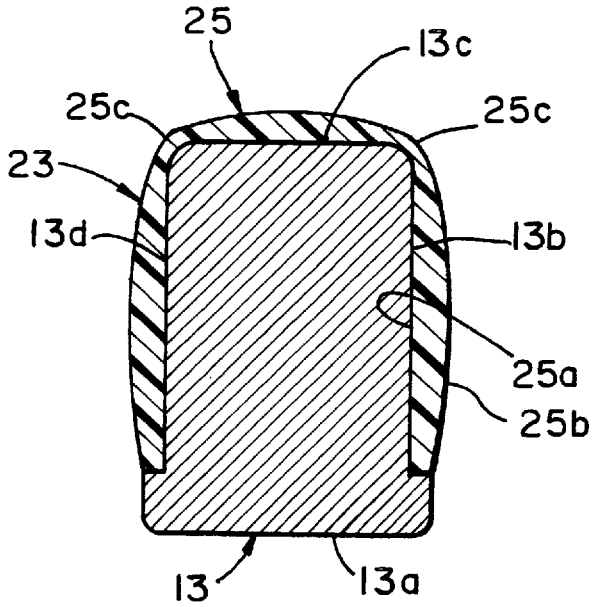
FIG. 3 is a sectional view taken along lines 3—3 of FIG. 2.
Figure 4:
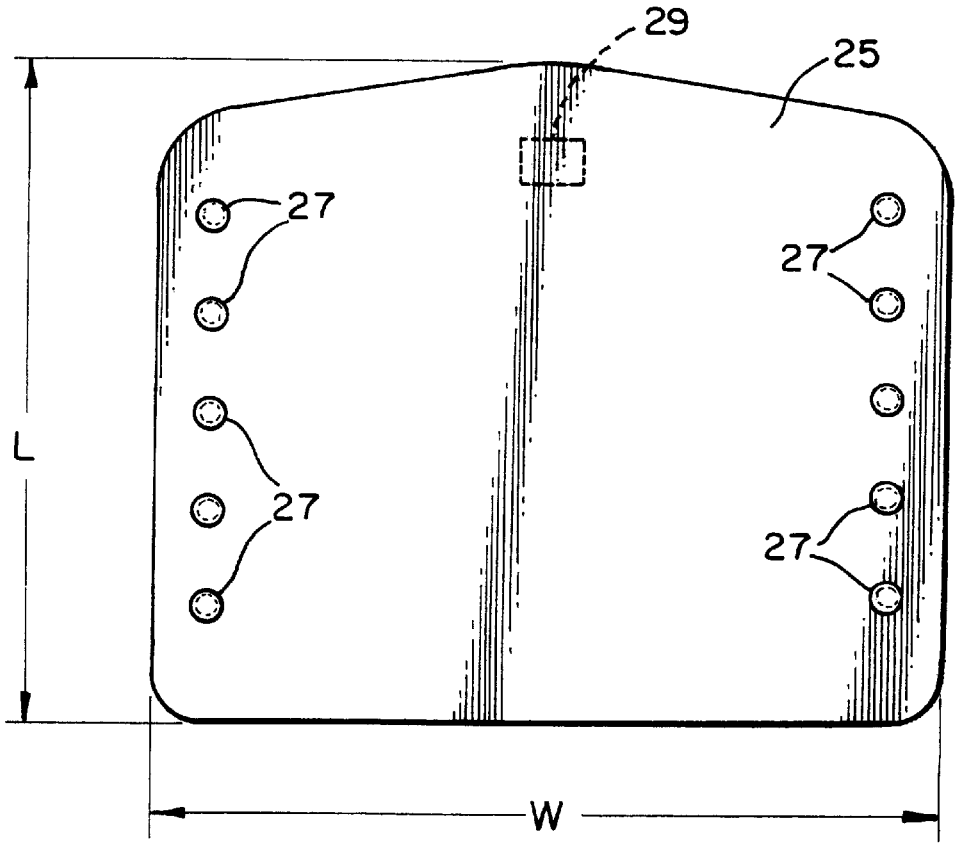
FIG. 4 is a bottom plan view of a user-replaceable grip in accordance with an embodiment of the invention; and, FIG. 5 is an end view of the grip shown in FIG. 4.
Figure 5:
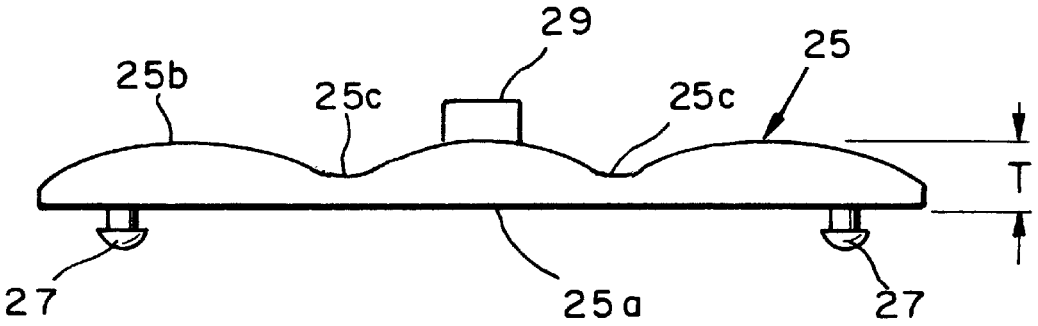

In a preferred embodiment, the user-replaceable grip comprises a releasably-attachable handle wrap 25 as best seen in FIGS. 3 and 4. In a preferred embodiment, the handle wrap 25 comprises a thin, pliable sheet of elastomeric material having a length L, width W, thickness T, attachment surface 25*a*, and gripping surface 25*b*. The attachment surface 25*a* of the wrap 25 is preferably planar so that the wrap will lay flatly in a recess seat 31 (described below) formed in the pipette gun handle 13. The gripping surface 25*b* of the wrap 25 is preferably contoured as best seen in FIG. 5 for added user comfort. The gripping surface 25*b* may be provided in a variety of contours for added comfort.

The wrap 25 has lengthwise-extending, reduced-thickness sections 25*c* which allow the wrap to be folded around the intersections of adjacent outer surfaces of the handle, i.e., the lengthwise-extending corners of the pipette gun handle 13.

Figure 2:
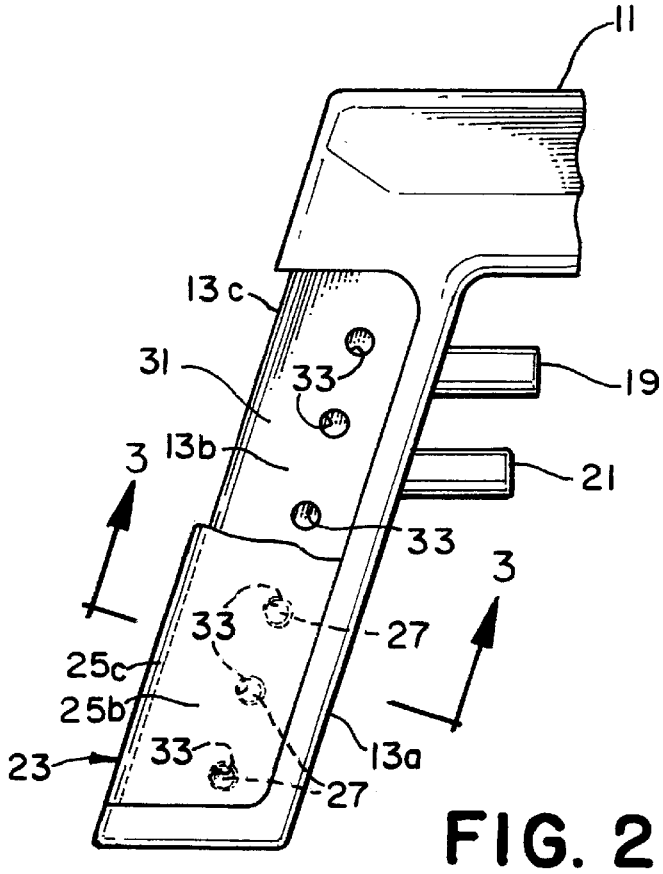
FIG. 2 is an enlarged, fragmentary view of the handle of the pipette gun shown in FIG. 1 without the user-replaceable grip.

Referring to FIGS. 1 and 2, the length L of the wrap 25 is preferably less than the length of the pipette gun handle while the width W of the wrap is preferably less than the girth of the pipette gun handle 13 minus the width of the trigger surface 13*a*. The wrap 25 is dimensioned so that the it wraps around three gripping surfaces 13*b*, 13*c*, 13*d* of the handle but not the gripping surface 13*a* from which the pipetting triggers 19, 21 extend. Alternatively, the wrap may be molded into a shape which wraps around or envelopes the gripping surfaces of the handle without interfering with the triggers.

The wrap 25 has releasable fasteners for releasably attaching the wrap 25 to the three outer gripping surfaces 13*b*, 13*c*, 13*d* of the handle 13. In a preferred embodiment, the fasteners comprise a plurality of pliable buttons 27 fixed to and extending from the attachment surface 25*a* of the wrap 25. The buttons 27 are preferably contiguously formed with the handle wrap 25 and have a mushroom shape as best seen in FIG. 5. The pliable buttons are constructed and arranged to be inserted into a plurality of apertures 33 formed in the recessed seat 31 (described below) formed in the handle 13.

The handle wrap 25 also includes a thumb rest 29 fixed to and extending from the gripping surface 25*b* as best seen in FIG. 5. The thumb rest is also preferably contiguously formed from the handle wrap 25.

The handle 13 of the pipette gun has a recessed seat 31 formed in the outer surface. The recessed seat 31 is formed in the three outer gripping surfaces 13*b*, 13*c*, 13*d*, and has a shape which compliments the shape of the wrap 25. The seat 31 includes a plurality of apertures 33 located proximate the perimeter of the seat. The apertures 13 are arranged in alignment with the buttons 27 so that each button 27 can be inserted into an aperture, thereby releasably fastening the wrap 25 in the recessed seat 31. Since the buttons 27 are pliable, the wrap 25 can be removed by simply applying a tearing force at one edge of the wrap 25 and pulling it until each of the buttons 27 is released from its respective aperture 33 in the recessed seat 31.

The invention provides a plurality of grips having the same lengthwise and widthwise dimensions but having different thicknesses T. Referring to FIG. 3, when the wrap 25 is applied to the handle 13 of the pipette gun, the wrap 25 enlarges the girth of the handle 13. A technician may select the wrap 25 which most comfortably enlarges the girth of the handle 13 so that repetitive use of the gun does not cause discomfort to the technician.

The gripping surface 25*b* of the handle wrap 25 is provided with identifying indicia 35 such as numbers, letters, specialized characters or color. The identifying indicia 35 is used to identify the pipette gun according to ownership, function, status, or the like. The identifying indicia 25 is preferably established on a reference key using generally accepted scientific symbols. For example, a red grip may correspond to a pipette gun being used to handle infectious blood; a yellow handle may indicate radioactive material; numbers may correspond to a particular technician.

Using the above-described user-replaceable grips, the shape and size of the pipette gun handle can be customized to the hand size of different users. In the method in accordance with an embodiment of the invention, a plurality of user-replaceable handle grips such as described above are provided wherein each grip has the same length and width but has a different thickness and/or contour. The technician selects one of the grips which most closely corresponds to the hand size of the technician. The technician then releasably fastens the selected grip to the handle of the pipette gun. Each time the pipette gun is used by a different technician, the new technician removes the old grip and applies the technician's own grip.

The invention also provides a method of identifying a pipette gun according to ownership, function, status, or the like. In the method according to this embodiment, a plurality of user-replaceable handle grips such as described above are provided wherein each grip has a different identifying indicia on the gripping surface. The pipette gun is initially identified according ownership, function, status, or the like. The technician then selects one of the grips with an identifying indicia which corresponds to identity of the pipette gun. The technician then fastens the selected grip to the pipette gun. Each time the identity, function, ownership, or the like of the pipette gun changes, a technician fastens a new handle grip to the pipette gun to designate the pipette gun's new identify. Preferably, the identifying indicia are established on a reference key which uses generally accepted scientific symbols.

What is claimed is:

1. A pipette gun having a handle which is adjustable in size, comprising:

a) an elongate handle base having a plurality of gripping surfaces which intersect at corners;

b) a trigger on one gripping surface of the handle base;

c) a recessed seat formed in a plurality of the gripping surfaces;

d) a handle grip having a shape which compliments said seat; and e) releasable fasteners removably attaching said grip to said handle in said recessed seat.

2. The pipette gun recited in claim 1, said seat being formed in each of the gripping surfaces except the trigger surface.

3. The pipette gun recited in claim 1, said grip comprising a thin, pliable sheet of elastomeric material having a length, width, thickness, planar attachment surface, and contoured gripping surface.

4. The pipette gun recited in claim 3, said grip having lengthwise-extending, reduced-thickness sections which overlap the corners of the handle base.

5. The pipette gun recited in claim 3, said length being less than the length of the handle, and said width being less than the girth of the handle minus the width of the trigger surface.

6. The pipette gun recited in claim 3, said grip having a thickness greater than the depth of the seat so that the girth of the base handle is enlarged in the area of the grip compared to the remaining portion of the handle.

7. The pipette gun recited in claim 6, including a plurality of handle wraps having different thicknesses.

8. The pipette gun recited in claim 1, said seat having a plurality of apertures located proximate the perimeter of the seat.

9. The pipette gun recited in claim 8, said grip having a plurality of pliable buttons fixed to and extending from the attachment surface of said grip, said buttons constructed and arranged to align with and insert into said apertures when said wrap is applied to said seat.

10. The pipette gun recited in claim 1, said grip having indicia which identifies the pipette gun according to ownership, function, status, said indicia comprising numbers, letters, specialized characters or color.

* * * * *